United States Patent [19]

Nozato

[11] Patent Number: 4,712,534

[45] Date of Patent: Dec. 15, 1987

[54] BALL THROWING MACHINE

[76] Inventor: Fujio Nozato, 33-20, Izuo 1-chome, Taisho-ku, Osaka 551, Japan

[21] Appl. No.: 855,574

[22] Filed: Apr. 25, 1986

[30] Foreign Application Priority Data

May 17, 1985 [JP] Japan ..... 60-106698

[51] Int. Cl.[4] ..... F41B 15/00

[52] U.S. Cl. ..... 124/78; 273/26 D

[58] Field of Search ..... 124/78, 49, 41 R, 83, 124/181; 273/26 D, 29 R

[56] References Cited

U.S. PATENT DOCUMENTS

| | | | |
|---|---|---|---|
| 2,316,798 | 4/1934 | Luebbe | 124/78 |
| 2,379,784 | 7/1945 | Brand | 124/78 |
| 2,716,973 | 9/1955 | Desi | 124/78 |
| 2,737,941 | 3/1956 | Carrau | 124/78 |
| 3,459,168 | 8/1969 | Bruce | 124/78 |
| 3,538,900 | 11/1970 | Samuels | 124/78 |
| 3,724,437 | 4/1973 | Halstead | 124/78 |
| 3,734,075 | 5/1973 | Staples | 124/78 |
| 3,774,584 | 11/1973 | Paulson | 273/26 D |
| 3,777,732 | 12/1973 | Holloway et al. | 124/78 |
| 3,794,011 | 2/1974 | Newgarden, Jr. | 273/26 D |
| 4,352,348 | 10/1982 | Griffith | 124/78 |

FOREIGN PATENT DOCUMENTS 56-114667 7/1981 Japan .

*Primary Examiner*—Richard C. Pinkham
*Assistant Examiner*—T. Brown
*Attorney, Agent, or Firm*—Armstrong, Nikaido, Marmelstein & Kubovcik

[57] ABSTRACT

A ball throwing machine comprising a first pair of counter-rotating wheels whose axes are parallel to each other, and a pair of second counter-rotating wheels which are disposed forwardly adjacent the first rotary wheels and whose axes are parallel to each other and substantially at right angles as seen in front view to the axes of the first rotary wheels. A ball is nipped between the outer peripheral surfaces of the first rotary wheels and accelerated, whereby the ball is propelled forward. Then, this propelled ball is nipped between the outer peripheral surfaces of the second rotary wheels and further accelerated and thereby thrown forward.

2 Claims, 4 Drawing Figures

BALL THROWING MACHINE

BACKGROUND OF THE INVENTION

This invention relates to a ball throwing machine used, e.g., for practicing batting balls and catching fly balls.

A prior art ball throwing machine is disclosed in U.S. Pat. No. 3,724,437. In the disclosed arrangement, a pair of counter-rotating wheels are used. A ball is nipped between the outer peripheral surfaces of said two rotary wheels, thereby accelerated and thrown forward.

In the aforesaid prior art machine, if the relative speed between the rotary wheels and the ball fed into between the rotary wheels is increased too high to throw the ball at high speed, a slip would be produced between the rotary wheels and the ball when the ball is nipped between the outer peripheral surfaces of the rotary wheels. In this case, the acceleration of the ball is insufficient and the ball cannot be thrown at high speed.

Further, said slip increases the rate of wear of the ball.

SUMMARY OF THE INVENTION

An object of this invention is to make it possible to throw a ball at high speed by smoothly accelerating the ball.

Another object of the invention is to inhibit the wear of a ball even when the ball is to be thrown at high speed.

A further object of the invention is to provide a ball throwing machine in a compact form which facilitates the handling of the machine.

BRIEF DESCRIPTION OF THE DRAWINGS

The drawings illustrate a preferred embodiment of the invention.

DESCRIPTION OF THE PREFERRED EMBODIMENTS

Figure 1:
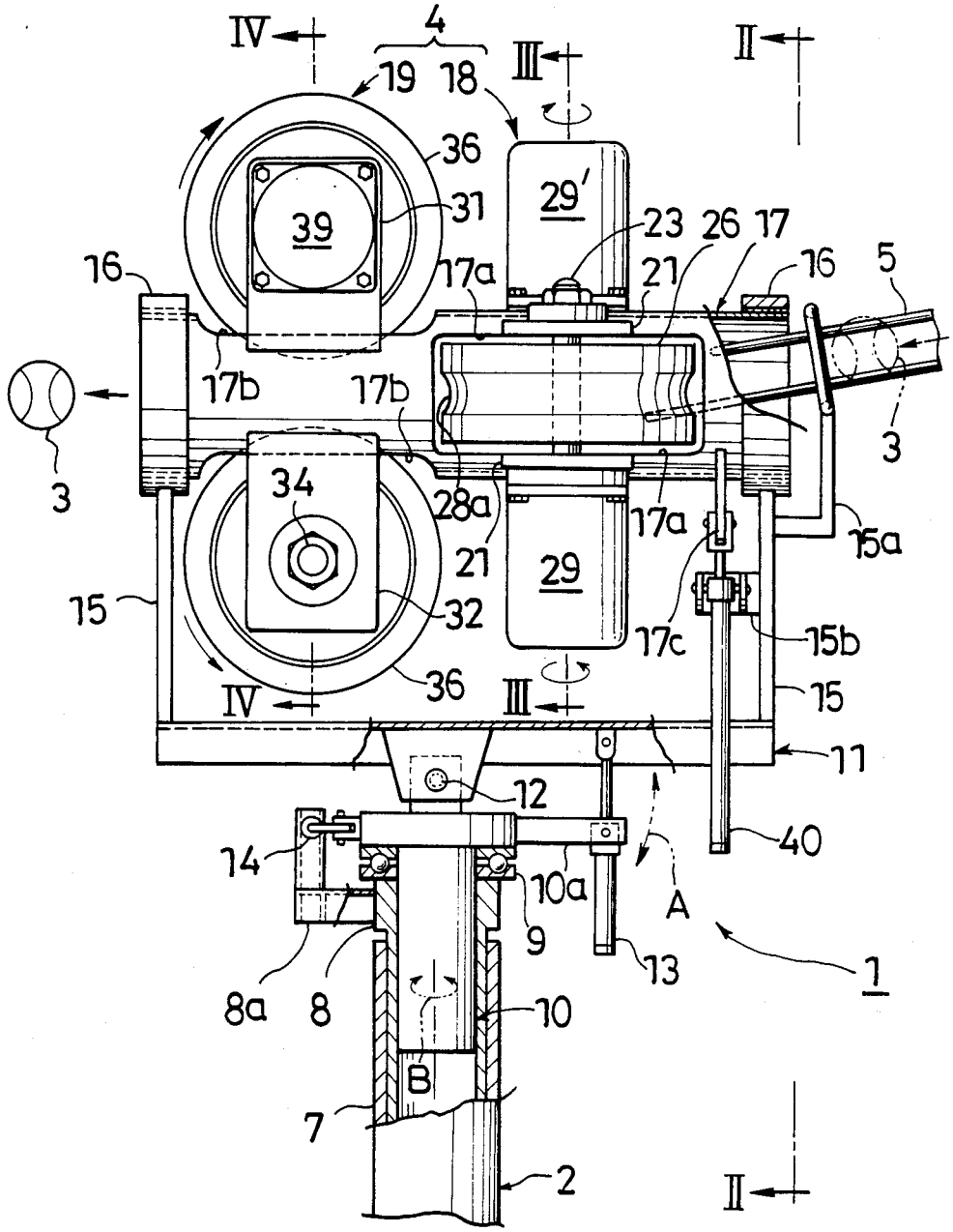
FIG. 1 is a side view of a ball throwing machine.
Figure 2:
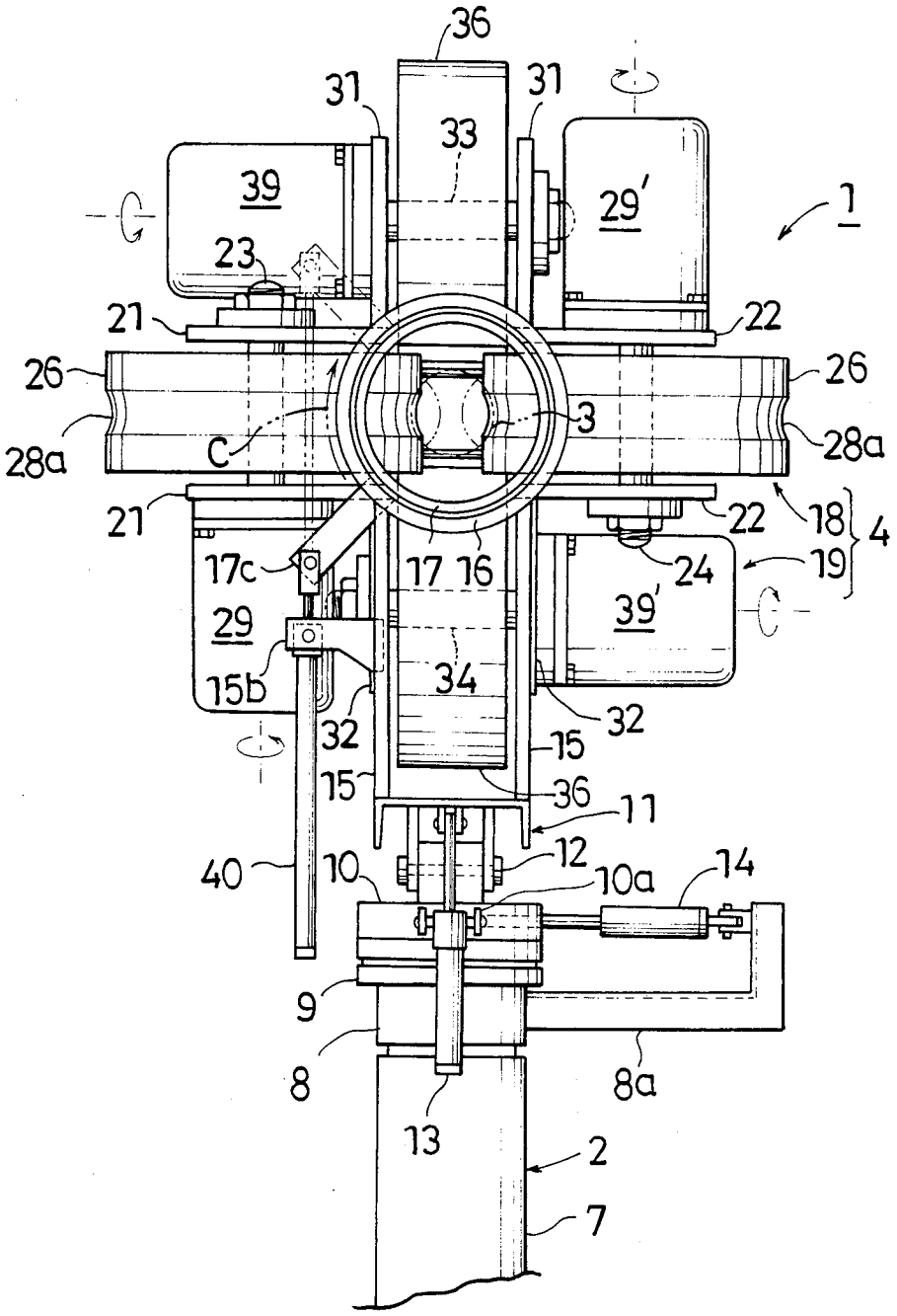
FIG. 2 is a sectional view taken in the direction of arrow II—II in FIG. 1.
Figure 3:
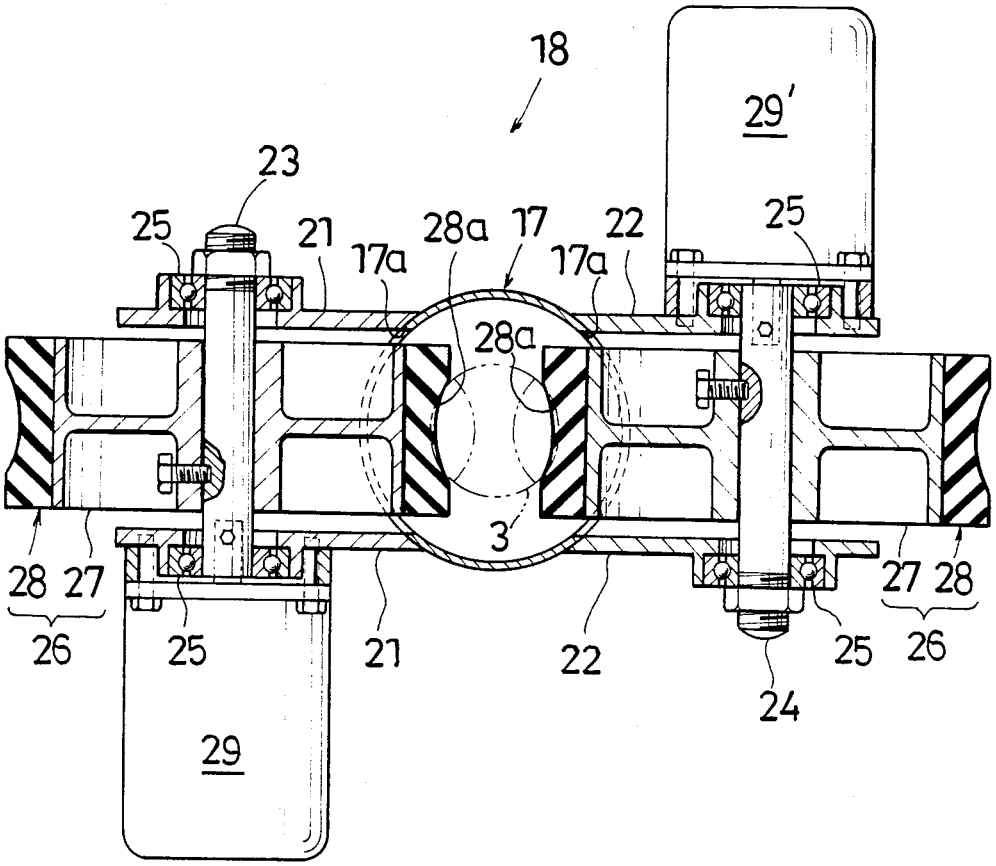
FIG. 3 is a sectional view taken in the direction of arrow III—III in FIG. 1.
Figure 4:
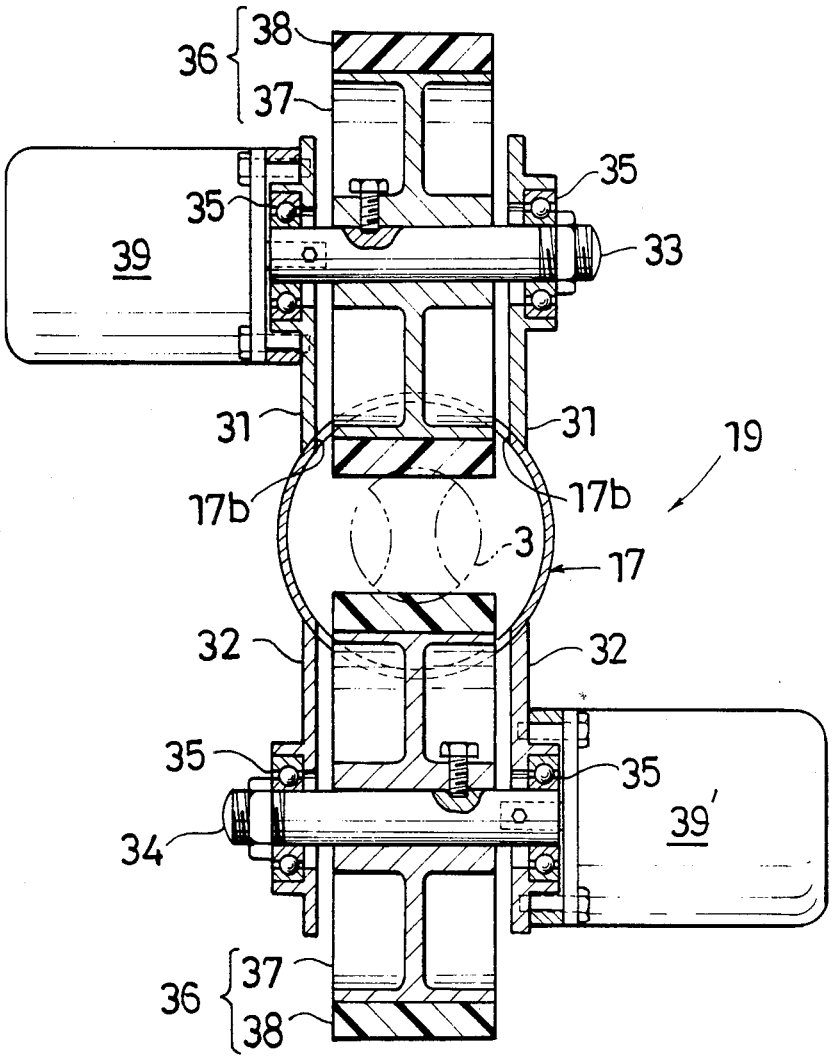
FIG. 4 is a sectional view taken in the direction of arrow IV—IV in FIG. 1.

A ball throwing machine 1 comprises a pillar 2, a main body 4 for the ball throwing machine 1 installed on said pillar 2, and a feed section 5 for feeding balls 3 to the main body 4.

The pillar 2 comprises a support pipe 7 of round cross-section, and a lifting pipe 8 vertically slidably fitted in said support pipe 7, said lifting pipe 8 being made vertically movable by unillustrated lifting means. A support member 10 is pivotally mounted on top of said lifting pipe 8 through a thrust bearing 9 so that it is turnable around its own axis. A base 11 for the ball throwing machine 1 is pivotally mounted on top of said support member 10 through a transversely directed pivot shaft 12 so that it is turnable back and forth.

To turn said base 11 back and forth, a vertically extending first hydraulic cylinder 13 is installed between said support member 10 and said base 11. The opposite ends of the first hydraulic cylinder 13 are hinged to a bracket **10*a* projecting from said support member 10 and to said base 11. Thus, the ball throwing angle of said main body 4 is vertically adjusted (as indicated by arrow A in FIG. 1) by the expansion and contraction of said first hydraulic cylinder 13**.

To turn said support member 10 around its own axis, a horizontally extending second hydraulic cylinder 14 is installed between said lifting pipe 8 and said support member 10. The opposite ends of the second hydraulic cylinder 14 are hinged to a bracket **8*a* projecting from said lifting pipe 8 and said support member 10. Thus, the ball throwing angle of said main body 4 is horizontally adjusted (as indicated by arrow B in FIG. 1) by the expansion and contraction of the second hydraulic cylinder 14**.

The main body 4 comprises two pivot rings 16 having a longitudinally extending common axis and projecting from a support frame 15 at the front and rear ends of said base 11, a ball throwing frame 17 in the form of a round pipe supported for turning movement around its own axis in said pivot rings 16 through bushings, first ball throwing means 18 disposed at the rear portion of the ball throwing frame 17 for accelerating and forwardly propelling balls 3 fed from the feed section 5, and second ball throwing means 19 disposed at the front portion of said ball throwing frame 17 for further accelerating and forwardly throwing balls 3 propelled by said first ball throwing means 18.

The first ball throwing means 18 has a pair of left-hand and right-hand side first rotary wheels 26 whose axes are parallel to each other. That is, the rear portion of the ball throwing frame 17 is formed on opposite sides with a pair of two rear openings **17*a* in rectangular form. Of these rear openings 17*a*, the left-hand side one 17*a* is formed with a pair of left-hand side brackets 21 projecting from the upper and lower edges thereof, and the right-hand side one 17*a* with a pair of right-hand side brackets 22 projecting from the upper and lower edges thereof. Left-hand and right-hand side rotary shafts 23 and 24 having vertically extending parallel axes are installed between said left-hand side brackets 22 and between said right-hand side brackets 22, respectively, the upper and lower ends of said left-hand and right-hand side rotary shafts 23 and 24 being rotatably supported in the left-hand and right-hand side brackets 21 and 22, respectively, through radial bearings 25. The first rotary wheels 26, which are in the form of disks of the same shape and size, are supported on said left-hand and right-hand side rotary shafts 23 and 24 intermediate between the ends thereof. Each first rotary wheel 26 comprises a disk 27 and an elastic member 28 of rubber in annular form covering the outer periphery of said disk 27. The outer peripheral surface of each said elastic member 28 is formed with peripheral groove 28*a* of arcuate cross-section. The outer peripheral portions of said elastic members 28 are fitted in said rear openings 17*a*, the distance between the elastic members 28 being somewhat smaller than the outer diameter of balls 3**.

The aforesaid feed section 5 is so designed as to feed balls 3 into between said first rotary wheels 26.

There are provided a pair of first electric motors 29 and 29' directly connected to said first rotary wheels 26 to rotate the latter in opposite directions. These electric motors 29 and 29' are disposed respectively on the axes of the first rotary wheels 26. The lower one of said left-hand side brackets 21 supports one first electric motor 29, while the upper one of said right-hand side brackets 22 supports the other first electric motor 29'. These two first electric motors 29 and 29' are rotated clockwise as viewed from the motor body side and at the same rotative speed. As a result, the first rotary wheels 26 are rotated in opposite directions and at the same peripheral speed.

The second ball throwing means 19, as seen in front view, intersects the axes of said first rotary wheels 26 substantially at right angles and has a pair of upper and lower second rotary wheels 36 whose axes are parallel to each other. More particularly, the front portion of said ball throwing frame 17 is formed with a pair of vertically spaced, rectangular front openings 17*b*. Of these two front openings 17*b*, the upper one 17*b* is formed with a pair of upper brackets 31 projecting from opposite edges thereof, while the lower one 17*b* is formed with a pair of lower brackets 32 projecting from opposite edges thereof. Upper and lower rotary shafts 33 and 34 having horizontally extending parallel axes are installed between said upper brackets 31 and between said lower brackets 32, respectively, the left-hand and right-hand side ends of said upper and lower rotary shafts 33 and 34 being rotatably supported in the upper and lower brackets 31 and 32, respectively, through radial bearings 35. The second rotary wheels 36, which are in the form of disks of the same shape and size, are supported on said upper and lower rotary shafts 33 and 34 intermediate between their respective ends. Each second rotary wheel 36 comprises a disk 37, and an annular elastic member 38 of urethane resin covering the outer periphery of said disk 37. The outer peripheral surface of each said elastic member 38 is linear and substantially parallel to its axis. Outer peripheral portions of said elastic members 38 are fitted in said front openings 17*b*, the distance between the outer peripheral surfaces of said elastic members 38 being somewhat smaller than the outer diameter of balls 3.

There are provided a pair of second electric motors 39 and 39' directly connected to said second rotary wheels 36 to rotate them in opposite directions.

The second electric motors 39 and 39' are disposed on the axes of the corresponding second rotary wheels 36. The left-hand side upper bracket 31 as viewed in the ball throwing direction supports one second electric motor 39, while the right-hand side bracket 32 as viewed in the ball throwing direction supports the other second electric motor 39'. These two second electric motors 39 and 39' are rotated clockwise as viewed from the motor body side and are variable in speed to any desired RPM. Thus, the second rotary wheels 36 are rotated in opposite directions as in the case of said first rotary wheels 26.

In the first and second ball throwing means 18 and 19, the first rotary wheels 26 are rotated at a speed, e.g., of 70 km/h and the second rotary wheels 36 at a speed, e.g., of 150 km/h. A ball 3 fed into between the first rotary wheels 26 from the feed section 5 is first nipped between the peripheral grooves 28*a* of the outer peripheral surfaces of the first rotary wheels 26 and accelerated to a speed of 70 km/h, whereby it is propelled forward. In this case, since the cross-section of said peripheral grooves 28*a* is arcuate, there is an increase in the area of contact between the ball 3 and the outer peripheral surfaces of the first rotary wheels 26 obtained when the ball 3 is nipped therebetween. Therefore, the slip of the ball 3 between the outer peripheral surfaces of the first rotary wheels 26 can be inhibited and the ball 3 reliably accelerated. Then the thus propelled ball 3 is fed into between the second rotary wheels 36. The thus fed ball 3 is nipped between the outer peripheral surfaces of the second rotary wheels 36 and accelerated to a speed of 150 km/h, whereby it is thrown forward. In this case, since the outer peripheral surfaces of the second rotary wheels 36 are flat, some error, if any, in the direction of propulsion of the ball 3 propelled at high speed from the first rotary wheels 26 can be easily accommodated. Therefore, the ball 3 can be reliably nipped between the outer peripheral surfaces of the second rotary wheels 36.

In the case of the aforesaid throwing of the ball 3, the relative speed between the second rotary wheels 36 and the ball 3 propelled by the first rotary wheels 26 is 80 km/h. Thus, there is no possibility that the speed of the ball 3 relative to the outer peripheral surfaces of the second rotary wheels 36 is not too high. Therefore, slippage of the ball 3 is prevented by the first and second rotary wheels 26 and 36, so that the ball 3 can be thrown at high speed and wear of the ball 3 is inhibited.

Since the axes of the first and second rotary wheels 26 and 36 intersect each other substantially at right angles as seen in front view, the first and second rotary wheels 26 and 36 can be positioned longitudinally close to each other while avoiding their interference. Thus, the ball 3 is received by the second rotary wheels 36 at a short distance from the first rotary wheels 26. Therefore, the ball 3 propelled by the first rotary wheels 26 is fed accurately to the predetermined position on the second rotary wheels 36; thus, the ball 3 can be smoothly accelerated by the second rotary wheels 36.

Moreover, since said first and second rotary wheels 26 and 36 can be positioned close to each other, the longitudinal dimension of the ball throwing machine 1 can be shortened. Therefore, the ball throwing machine 1 can be made compact and hence the handling of the ball throwing machine 1 facilitated.

If the second rotary wheels 36 are rotated one at a speed different from that of the other, the ball 3 will be rotated around a horizontal axis which is at right angles to the ball throwing direction. As a result, various pitches which change in a vertical direction, including hops and drops, are obtained.

To turn said ball throwing frame 17 around its axis, a third hydraulic cylinder 40 is installed between said support frame 15 and said ball throwing frame 17. The opposite ends of said third hydraulic cylinder 40 are respectively hinged to a bracket 15*b* projecting from the support frame 15 and to a bracket 17*c* projecting radially outward from the ball throwing frame 17. The ball throwing frame 17 is turned around its axis (as indicated by arrow C) by the expansion and contraction of said third hydraulic cylinder 40. When the ball throwing frame 17 is turned to a desired attitude and when the second rotary wheels 36 are rotated one at a speed different from that of the other, the ball 3 will be rotated around a desired axis. Therefore, various pitches are obtained.

In the ball throwing machine 1 described above, a pair of electric motors for a pair of rotary wheels are positioned on opposite sides with respect to the rotary wheels. As a result, even when the ball throwing frame 17 is turned, the main body 4 can be balanced. Therefore, there is no possibility of the pillar 2 being overloaded, so that accurate pitching can be attained by using the ball throwing machine 1.

What is claimed is:

1. A ball throwing machine including a pair of first counter-rotating rotary wheels having axes parallel to each other, at least one first motor driving said pair of first rotary wheels, means for feeding balls to said pair of first rotary wheels, each of said first rotary wheels having an arcuately grooved outer peripheral surface for nipping a ball fed therebetween and accelerating and propelling said ball forward of said pair of first rotary wheels along a free path substantially tangent to said wheels of said pair of first rotary wheels, a second pair of counter-rotating rotary wheels located in said ball propelling path and forwardly of said first rotary wheels with the tangents of the wheels of said second pair of wheels in substantial alignment with said free path, said second pair of rotary wheels having axes parallel to each other and substantially at right angle to said axes of said pair of first rotary wheel as view from said propelling path, each of said second rotary wheels having a linear peripheral outer surface, the outer linear peripheral outer surfaces of said second rotary wheels being substantially parallel to each other and to the axes of said second rotary wheels, at least one second motor driving said pair of second rotary wheels, the arrangement being such that the ball accelerated and propelled by said first rotary wheels along said free path tangent to said pair of first wheels is caught by and nipped between the outer peripheral surfaces of said second rotary wheels, is further accelerated and is thrown forward and out of said ball throwing machine by said pair of second rotary wheels.

2. A ball throwing machining as set forth in claim 1, wherein said at least one first motor and said at least one second motor are pairs of individual electric motors respectively mounted on the axes of said pair of first and second pair of second rotary wheels for driving the rotary wheels, each pair of electric motors for the associated pair of rotary wheels being disposed so that one electric motor is on one side of one of said pairs of rotary wheels and the other of said motor is on the opposite side of the other of said pairs of rotary wheels.

* * * * *